United States Patent [19]

Brandes

[11] 3,972,523

[45] Aug. 3, 1976

[54] SHEET BRAKE FOR PRINTING PRESS DELIVERY

[75] Inventor: Harry Brandes, Jugesheim, Germany

[73] Assignee: Roland Offsetmaschinenfabrik Faber & Schleicher AG, Offenbach, Germany

[22] Filed: Oct. 30, 1975

[21] Appl. No.: 627,053

[30] Foreign Application Priority Data

Nov. 13, 1974 Germany ..... 2453753

[52] U.S. Cl. ..... 271/183; 226/195

[51] Int. Cl.[2] ..... B65H 29/68

[58] Field of Search ..... 271/183, 204, 205, 206

[56] References Cited

UNITED STATES PATENTS

| | | | |
|---|---|---|---|
| 3,779,545 | 12/1973 | Schuhmann | 271/183 |
| 3,813,020 | 5/1974 | Miller | 226/97 |

*Primary Examiner*—Richard A. Schacher

*Attorney, Agent, or Firm*—Leydig, Voit, Osann, Mayer & Holt, Ltd.

[57] ABSTRACT

A delivery arrangement for a printing press having a conveyor releasing sheets one by one and which includes a jet type vacuum pump facing and closely spaced to the path of a released sheet for slowing the forward movement thereof. The vacuum pump includes a venturi nozzle having a throat at its inlet end and over which is superimposed an injector. The injector has a central opening which is in register with the throat and which is in slightly overhanging relation so that the lip of the opening forms an annular orifice adjacent the throat, the orifice being supplied with air from a pressure chamber which surrounds the nozzle. When the pressurized air flows through the orifice in the form of an annular jet, it is deflected along the wall of the throat by the so-called "Coanda effect" and subsequently expanded, with the resulting venturi action, creating suction at the opening. The suction causes a drag on each passing sheet. A series of such vacuum pumps are spaced across the width dimension of the sheet, separately supplied by high pressure lines of small diameter but with a common exhaust at a remote point. In the preferred embodiment each pump is provided with a disc which defines a small vacuum plenum and which includes elongated transverse slits for applying suction to the sheet.

8 Claims, 5 Drawing Figures fig.1.
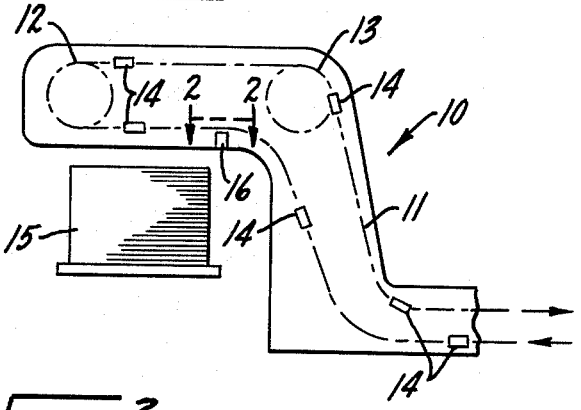
fig.2.
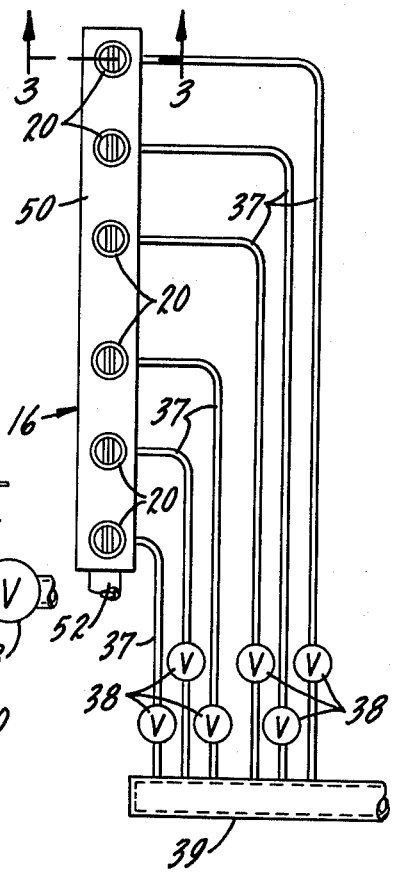
fig.3.
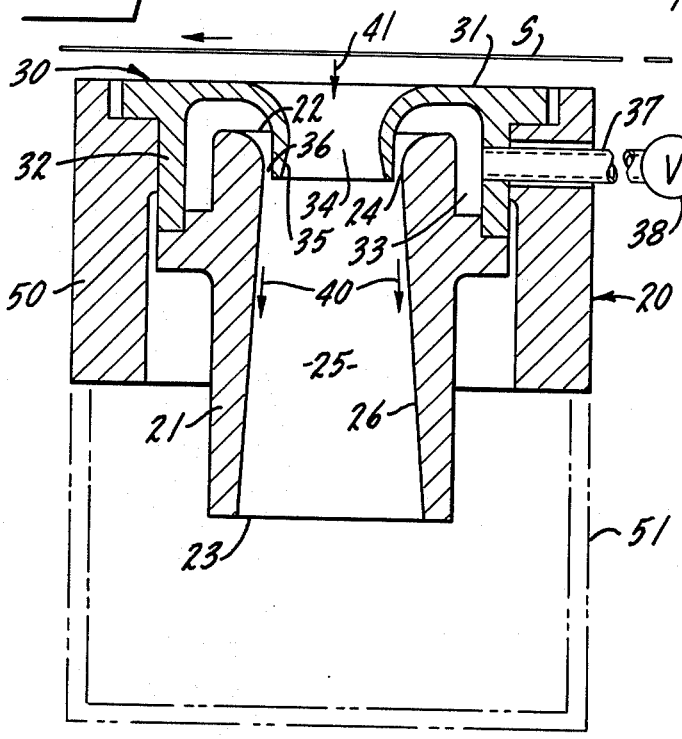
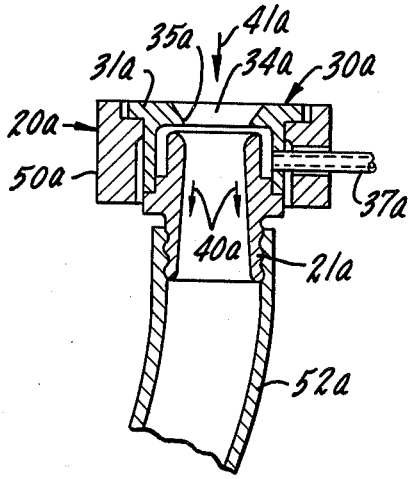
fig.5.
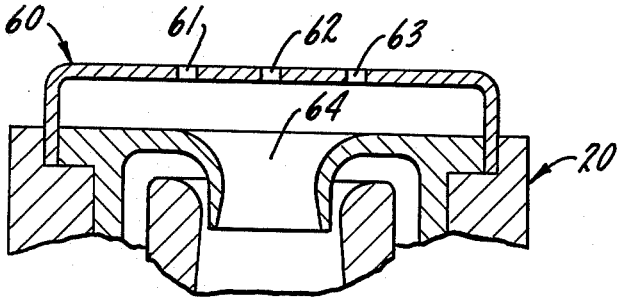
fig.4.

SHEET BRAKE FOR PRINTING PRESS DELIVERY

It is known to employ a vacuum to decelerate a sheet for depositing on a delivery pile, with the vacuum being created by one of the known types of mechanical vacuum pumps. All such vacuum systems have the disadvantage that paper dust, including glue particles, are sucked into the system creating a deposit which is difficult and expensive to remove resulting in costly maintenance. While it is possible to employ a filter ahead of the vacuum pump, such a filter cannot protect the suction head. In any event, use of a filter involves a troublesome compromise: either the filter must be constructed with large passageways capable of removing only large particles or, if more complete removal is required, with small passageways resulting in a large pressure drop which can only be corrected by going to a filter which is impractically large and expensive.

The location of a filter in a vacuum system also presents a problem. The filter cannot be located directly behind the suction head because of limited space within the press structure. If the filter, on the other hand, is located at some distance from the head, and outside of the press structure, the air conduit between the suction head and the filter is unprotected, requiring the press to be shut down from time to time in order to clean out the accumulated deposit.

Finally, conventional vacuum lines must be of large diameter, difficult to install, and taking up much space.

In order to avoid the well known disadvantages of a vacuum braking system, it is common to employ jets of compressed air directed along the passing sheet in a direction opposite to sheet movement, as shown, for example, in German Disclosure Specification DAS No. 2,135,105. The sheet in such a system, in addition to being slowed by air friction, may be drawn downwardly by venturi action against the upper edge of the blowing nozzles. While this augments the braking effect it runs risk of defacing the sheet. However, the most serious disadvantage of using jets of pressurized air for direct braking effect is that destructive fluttering of the sheets may occur, particularly in the case of sheets of thin gauge. A still further disadvantage is that the paper dust, instead of being disposed of, is blown back to accumulate in the printing press.

It is, accordingly, an object of the present invention to provide a sheet delivery arrangement having means for braking the forward movement of the sheets which avoids the difficulties and disadvantages associated with prior braking systems of both the vacuum type and the type using pressurized air jets. It is more specifically an object of the present invention to provide a brake in the form of a jet type vacuum pump which is fed from a source of air at high pressure but which nevertheless exerts suction upon the sheet for braking purposes, with the vented air being discharged at a point remote from the path of movement of the sheets.

It is a further object to provide a jet type vacuum pump at a point of sheet delivery which permits use of highly compressed air which may be fed to the pump through flexible feed lines of small diameter taking up very little space within the press structure, which are easily and quickly installed, and in which the air flow is subject to adjustment by remote valves of small size, enabling the system to be installed, maintained and operated at a fraction of the usual cost of a conventional braking system.

It is a related object to provide a braking arrangement for a printing press sheet delivery in which the compressed air is expanded incident to producing a vacuum and subsequently vented and with the vent conduit being open and unrestricted over its entire length for free discharge so that the vacuum pump may operate at high efficiency with minimum back pressure and so that dust particles entering the vacuum pump tend to be kept in suspension in the air stream in "diluted" form until final discharge. It is a more specific object to provide a sheet braking system for the delivery portion of a printing press which is free of any mechanical means for producing vacuum and which on the contrary produces vacuum by pressurizing a venturi which discharges into an exhaust conduit which may be vented directly, for example, out of doors, without necessity for using a filter with its attendant maintanence problems.

From an operational point of view it is an object of the present invention to provide means utilizing highly pressurized air for braking passage of a delivered sheet but which avoids any contact of pressurized air with the sheet and which thereby avoids completely any tendency toward fluttering. It is a related object to provide a sheet-braking means which acts in such a fashion that the sheet is always stable and under control and in which the degree of braking action may be easily and precisely adjusted by the simple expedient of providing a small throttling valve in the pressurized line feeding each of the vacuum pumps.

Other objects and advantages of the invention will become apparent upon reading the attached detailed description and upon reference to the drawings in which:

FIG. 1 is a diagrammatic side view of the delivery portion of a printing press.

FIG. 2 is a fragmentary plan view looking along the line 2—2 in FIG. 1 and showing a braking bar in the form of an exhaust manifold supporting a series of transversely spaced vacuum pumps.

FIG. 3 is a cross sectional view taken through one of the vacuum pumps and looking along the line 3—3 in FIG. 2.

FIG. 4 is a fragmentary elevational view showing use of a slotted disc to form a plenum above an individual vacuum pump, with the slots extending perpendicularly to the direction of sheet movement.

FIG. 5 is a sectional view similar to FIG. 3 but showing a vacuum pump of slightly modified construction having its own exhaust conduit.

While the invention has been described in connection with certain preferred embodiments, it will be understood that I do not intend to be limited to the disclosed embodiment but intend, on the contrary, to cover the various alternative and equivalent forms of the invention included within the spirit and scope of the appended claims.

Referring now to FIG. 1 there is shown a delivery portion 10 of a printing press having an endless chain 11 trained about sprockets 12, 13 carrying grippers 14 at spaced intervals. Means (not shown) are provided for opening the passing grippers at a point above a pile 15 for the purpose of depositing the sheets one by one upon the pile. For the purpose of decelerating the forward movement of the sheets a braking assembly 16 is provided capable of exerting vacuum (suction) upon the underside of the sheets with the effect being distributed along the full width thereof.

A jet type vacuum pump 20, which serves as a suction head, and which is constructed in accordance with the invention, is illustrated in FIG. 3, the pump facing and closely spaced to the path of a passing sheet S. The vacuum pump includes a venturi nozzle member 21 having an inlet end 22 and a discharge end 23. The inlet end 22 has a presented edge defining a narrowed throat 24 which feeds a central space 25 having a flaring side wall 26. An injector element 30, of cup shape, is telescopingly registered over the inlet end 22 of the venturi nozzle, the injector having a disc portion 31 and an annular skirt portion 32, the skirt portion being radially spaced from the inlet end of the venturi nozzle to form an annular air chamber 33 which surrounds the inlet end.

The disc portion 31 of the injector is axially spaced from the presented edge at the inlet 22 of the venturi nozzle and is centrally perforated to provide a central air inlet opening 34 which is surrounded by a convergent lip 35 which overhangs the inlet end 22 of the venturi nozzle and which defines with the inlet a restricted annular orifice 36 communicating with the annular pressure chamber 33. In order to furnish air under pressure to the pressure chamber 33, a high pressure, small diameter, pressure line 37 is provided to which air is admitted under the control of a throttling valve 38 from a pressurized manifold 39. The latter may be supplied from a suitable sir pump at a pressure on the order of 15 to 20 pounds per square inch at a flow rate, in a practical case which may be on the order of 2 to 5 cfm. The pressure and aperture are so adjusted that the induced dust-containing air is diluted by an amount of pressurized fresh air at least equal to the amount of induced air.

In operation, turning on the valve 38 feeds pressurized air to the annular space 33 which in turn feeds air to the restricted annular orifice 36. This produces an air jet of annular shape as indicated at 40 which is directed, by the so-called "Coanda effect," along the curved wall of the throat 24, which merges with the flaring wall 26. This creates suction by venturi action, at the center opening 34 as indicated by the arrow 41. The suction, acting upon the passing sheet, creates a drag sufficient to brake the forward velocity of the sheet so that the sheet settles in orderly fashion upon the pile 15.

The amount of braking effect is adjustable by the valve 38. It is not necessary to exert sufficient vacuum to suck the sheet down into frictional contact with the top surface of the unit. It is contemplated, however, that the invention may be practiced in either the contacting or non-contacting mode depending upon the closeness of spacing to the path of the released sheet and depending upon the adjustment of the throttling valve 38.

In accordance with one of the aspects of the present invention a plurality of jet type vacuum pumps 20 are provided in a series generally arranged along a line which is perpendicular to the path of sheet movement so that the braking force is distributed over substantially the entire width of the sheet. Further in accordance with the invention all of the vacuum pumps in the series are recessed in a common "brake bar," which may, if desired, be enclosed to form a manifold, with the discharge ends of all of the pumps being in communication with the space within the manifold for common discharge of the vented air remotely from the passing sheets.

Thus I provide a plurality of vacuum pumps 20, for example six in total number, all mounted in recessed position in a brake bar 50 of elongated boxy shape, with the pumps being fed by individual pressurized lines 37 from individual throttle control valves 38 fed from a pressurized supply manifold 39. The brake bar may be enclosed as indicated at 51 (FIG. 3) and provided with an exhaust conduit 52 (FIG. 2) which serves to conduct the vented air to a point of disposition clear of the sheets and, preferably, clear of the press itself. It is one of the features of the present invention that the conduit 52 may operate open and unrestricted for free discharge of the vented air so that there is minimum back pressure on the venturi nozzles and so that any dust particles entering the central opening 34 are kept in suspension until final discharge. Thus the conduit may be free of any filter or other artificial obstruction and, if desired, the conduit may be directly discharged out of doors. The amount of contained dust, while capable of clogging a conventional vacuum braking system and creating an expensive maintenance problem is nonetheless sufficiently small so as to permit direct discharge without objectionable pollution. The high air velocity at the orifice 36 serves to keep the head itself free of deposit.

In accordance with another aspect of the present invention an apertured disc having at least one elongated, narrow slit opening is provided superimposed upon each of the jet pumps for the purpose of defining a vacuum plenum and to increase efficiency by distributing the braking effect along the width dimension of the sheet. Thus, referring to FIG. 4, I provide a disc 60 having three elongated slits 61, 62, 63 which extend perpendicular to the direction of movement of the sheet, the disc 60 serving to define a vacuum plenum 64 so that vacuum is applied to approximately equal degree along the entire length of each of the slits.

While the invention has been described in the form of a preferred embodiment in FIGS. 3 and 4, the vacuum pump may be constructed, if desired, as shown in cross section in FIG. 5, with similar elements being indicated by the same reference numeral with addition of subscript *a*. As will be noted, the main difference between the two constructions is that the disc portion 31*a* of the injector 30*a* has a central opening 34*a* surrounded by a tapered lip 35*a* which overhangs the throat but which does not, however, extend reentrantly into the throat in the fashion of the lip 35 in the preceding embodiment. Moreover, for the purpose of disposing of exhaust air, the jet pump 30*a* has an individual exhaust conduit 52*a*.

The effectiveness of the braking arrangement is at least as great as that where a plurality of braking suction heads are serviced by a mechanical vacuum pump. However, the disadvantages of a conventional vacuum arrangement have been entirely overcome. In the first place there is no vacuum pump in the path of the exhausted air and which is subject to accumulation of paper dust, ink mist and glue particles in a hard, difficult to remove layer. Nor is it necessary to use a filter in an effort to protect the line and vacuum pump from the accumulation and the associated maintenance problems, with the servicing of the filter being a serious maintenance problem in itself. Due to the fact that there is no restriction or point of sudden pressure drop in the vacuum manifold and its discharge conduit, due to the addition of the clean pressurized air, and due to the fact that the exhaust air moves through the conduit at high velocity, the dust particles are "diluted" and largely kept in suspension both at the head itself and until the point of final discharge which may, as stated, be out of doors. Installation is greatly simplified since small diameter high pressure lines 37 may be employed which are flexible, easily routed and which require practically no space within the delivery structure. It is a simple matter too, upon installation, to change the axial spacing between the venturi nozzle and injector member thereby to change the cross section of the discharge orifice enabling the same pump to be used universally for various operating conditions. Such adjustment may be brought about by providing a shallow screw thread between the nozzle and the injector 30.

The valves 38 not only serve to adjust the degree of braking but also, upon shut-off, serve as a convenient silencing means to tailor the brake bar 50 for a narrower sheet width.

Similarly, problems associated with known types of pressurized braking systems are obviated, primarily the destructive fluttering and distortion of the sheets which often occurs and the fact that the paper dust and other impurities are blown back into the press rather than being safely evacuated.

I claim:

1. In a delivery arrangement including a conveyor chain with grippers for feeding sheets seriatim to the delivery of a printing press and for releasing sheets above the delivery pile, the combination including a jet type vacuum pump facing and closely spaced to the path of a passing sheet for braking the forward movement of the sheet so that it settles vertically on the pile, the vacuum pump including a venturi nozzle having an inlet end and a discharge end, the venturi nozzle having a presented edge defining a narrowed throat at the inlet and a central space having a wall which merges with the throat and flares outwardly to the discharge end of the nozzle, an injector member having a central opening registered over the inlet end of the venturi nozzle and axially spaced therefrom, the central opening being surrounded by a lip which overhangs the inlet end of the venturi nozzle and which defines with the inlet end a restricted annular orifice adjacent the throat of the nozzle, means defining an annular chamber surrounding the inlet end of the venturi nozzle and communicating with the annular orifice, means for feeding air under pressure to the annular chamber so that an annular jet of air flows through the annular orifice along the wall of the throat and along the flaring wall of the central space to create suction at the throat by venturi action, the suction causing induction of ambient air through the central opening to produce a drag upon the passing sheet, and an air conduit at the discharge end of the venturi nozzle for discharging the air vented from the nozzle at a point remote from the passing sheet.

2. The combination as claimed in claim 1 in which a series of the jet type vacuum pumps are provided facing and closely spaced to the path of movement of the passing sheet and arranged generally along a line which is perpendicular to the path of sheet movement so that the sheet is acted upon by suction to produce a braking force distributed over substantially the entire width of the sheet, the pumps having individual supply lines of small diameter for furnishing pressurized air thereto and having means including an exhaust conduit for receiving the air vented therefrom.

3. The combination as claimed in claim 2 in which each of the supply lines has a remote throttle valve for connecting the supply line to a pressure manifold for individual localized control of the suction and capable of shut-off for silencing selected ones of the pumps to accommodate sheets of lesser width.

4. The combination as claimed in claim 2 which includes a hollow exhaust manifold extending perpendicularly to the path of sheet movement and in which all of the vacuum pumps in the series are recessed with the discharge ends all in communication with the center of the manifold, and means including a conduit for common discharge of the vented air from the manifold remotely from the passing sheet.

5. The combination as claimed in claim 1 in which an apertured disc is superimposed over the central opening so as to define a vacuum plenum, the disc having at least one elongated narrow slit type opening which extends perpendicular to the direction of movement of the sheet thereby to distribute braking effect along the width dimension of the sheet.

6. The combination as claimed in claim 5 in which the apertured disc includes a plurality of narrow parallel slits extending perpendicularly to the direction of movement of the sheet.

7. The combination as claimed in claim 1 in which the induced air is diluted by at least an equal amount of fresh pressurized air and in which the conduit is substantially unrestricted for free discharge of the vented air so that there is minimum back pressure on the venturi nozzle with the result that any dust particles entering the central opening tend to be in suspension until final discharge.

8. In a delivery arrangement including a conveyor chain with grippers for feeding sheets seriatim to the delivery of a printing press and for releasing sheets above the delivery pile, the combination including a jet type vacuum pump facing and closely spaced to the path of a passing sheet for braking the forward movement of the sheet so that it settles vertically on the pile, the vacuum pump including a venturi nozzle having an inlet end and a discharge end, the venturi nozzle having a presented edge defining a narrowed throat at the inlet and a central space having a wall which merges with the throat and flares outwardly to the discharge end of the nozzle, an injector member of cup shape telescopingly registered over the inlet end of the venturi nozzle, said injector member having a disc portion and an annular skirt portion, the skirt portion being radially spaced from the inlet end of the venturi nozzle to define an annular chamber surrounding the inlet end, the disc portion of the injector member being axially spaced from the presented edge at the inlet end of the venturi nozzle and perforated by a central opening, the central opening being surrounded by a convergently shaped lip which overhangs the inlet end of the venturi nozzle and which defines with the inlet end a restricted annular orifice adjacent the throat and which communicates with the annular chamber, means for feeding air under pressure to the annular chamber so that an annular jet of air flows through the annular orifice along the wall of the throat and along the flaring wall of the central space to create suction at the throat by venturi action, the suction creating an inward movement of ambient air through the central opening to produce a drag upon the passing sheet.

* * * * *